United States Patent [19]

Weber

[11] Patent Number: 4,467,777

[45] Date of Patent: Aug. 28, 1984

[54] GAS OR ELECTRICALLY HEATED CONVECTION AIR OVEN FOR BAKING FOODS

[75] Inventor: Hans-Rudolf Weber, Rothrist, Switzerland

[73] Assignee: Niro Plan AG, Zurich, Switzerland

[21] Appl. No.: 522,511

[22] Filed: Aug. 12, 1983

Related U.S. Application Data

[63] Continuation-in-part of Ser. No. 282,084, Jul. 10, 1981, abandoned.

[30] Foreign Application Priority Data

Jul. 10, 1980 [CH] Switzerland ..... 5329/80
Jun. 15, 1981 [CH] Switzerland ..... 3920/81

[51] Int. Cl.[3] ..... A21B 1/08
[52] U.S. Cl. ..... 126/21 A; 219/400
[58] Field of Search ..... 126/21 R, 21 A, 273 R; 432/51, 199, 176; 219/400

[56] References Cited

U.S. PATENT DOCUMENTS 1,923,145 8/1933 Harsch ..... 432/199
3,620,520 11/1971 Ross et al. ..... 432/51
3,802,832 4/1974 Nicolaus ..... 99/447
3,861,378 1/1975 Rhoads et al. ..... 126/21 A
3,991,737 11/1976 Fabbro ..... 126/21 A
4,029,463 6/1977 Johansson et al. ..... 126/21 A

*Primary Examiner*—Carroll B. Dority, Jr.
*Attorney, Agent, or Firm*—James E. Nilles

[57] ABSTRACT

The baking oven (1) has a swingable front wall (2), two side walls (3, 4), a rear wall (5) and a bottom wall (6). They establish a baking chamber (7) in the main portion. At the rear wall (5) is a gas-air mixing chamber (8) with a gas inlet duct (11). Next to it there are four motors (9 and 10). These drive radial blower rotors (12 and 13). Opposite the nozzle block (28) lies a heat exchanger (15). This is of the surface type. It is wavy in one direction so that it has wave crests and wave troughs. Main nozzles (29) are provided on the wave crests, the auxiliary nozzles (30) for the pilot flames are arranged in the wave troughs. The nozzles (29 and 30) produce a short-flamed, coherent flame carpet. On its longitudinal sides four radial blowers (12, 13) are arranged. They are individually regulatable and are reversible as to direction of rotation. Throughout the baking chamber nearly uniform temperature conditions prevail. In operation, the oven produces less noise, due to plural small air circulation blowers.

3 Claims, 8 Drawing Figures

GAS OR ELECTRICALLY HEATED CONVECTION AIR OVEN FOR BAKING FOODS

This application is a continuation-in-part of Ser. No. 282,084, filed July 10, 1981, now abandoned.

The present invention relates to a gas or electrically heated convection air oven for baking foods, having blower means for producing circulation whereby substantially uniform temperature and humidity are maintained throughout the baking chamber.

Existing convection air ovens have the disadvantage that they are not optimally configured from the standpoint of heat technology, particularly in that they do not provide uniform temperature conditions in the baking chamber and/or in that they are noisy in operation as a result of the air circulating blower.

The present invention has for its purpose the provision of a convection air oven that does not have these disadvantages and which, furthermore, can provide optimum conditions with respect to baking uniformity as well as air mixing and heat utilization.

A convection air oven of this type is characterized in that switch means are arranged to periodically change the direction of rotation of the blower means, and the blower means comprises an even number of rotors, arranged symmetrically to a vertical medial plane of the oven, each embraced by a housing or shell, the blower means being periodically reversed to produce two different patterns of circulation in the baking chamber that alternate with one another, each of these patterns of circulation being characterized by substantial turbulence that assures a thorough mixing of air and consequent uniform conditions of temperature and humidity in all parts of the baking chamber.

An exemplary embodiment of the inventive subject matter is hereinafter explained with reference to a purely schematic showing.

Figure 5:
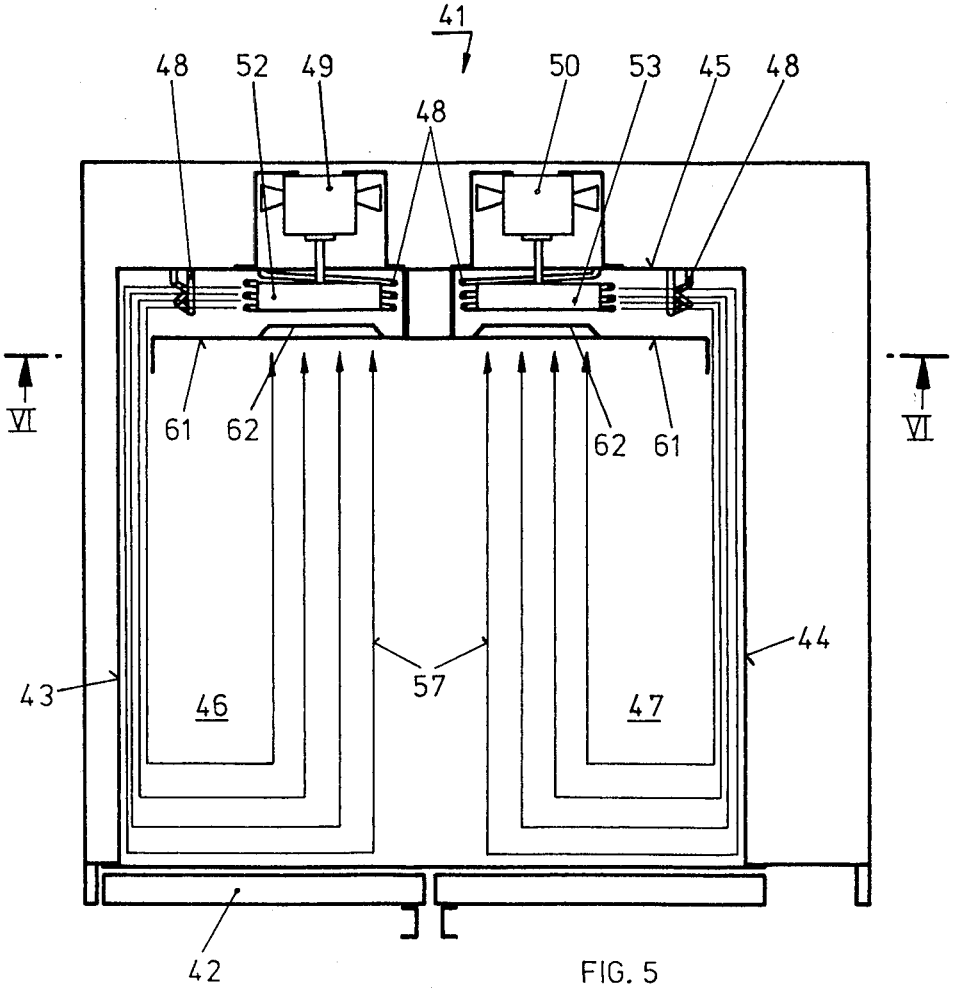
FIG. 5 is a horizontal section through a convection air oven of electric type.
Figure 6A:
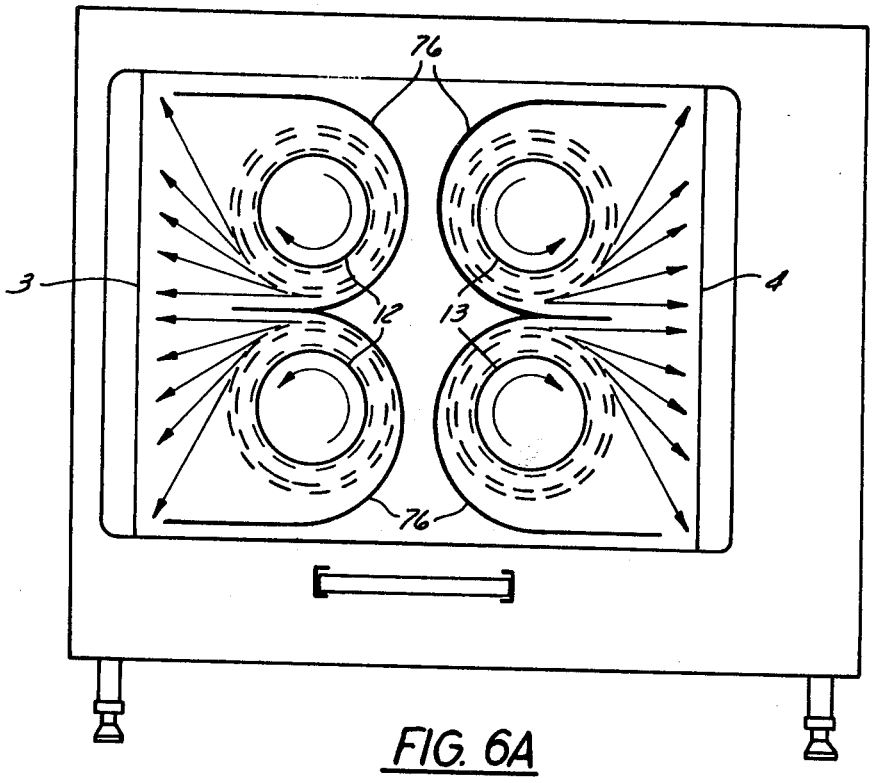
Figure 6B:
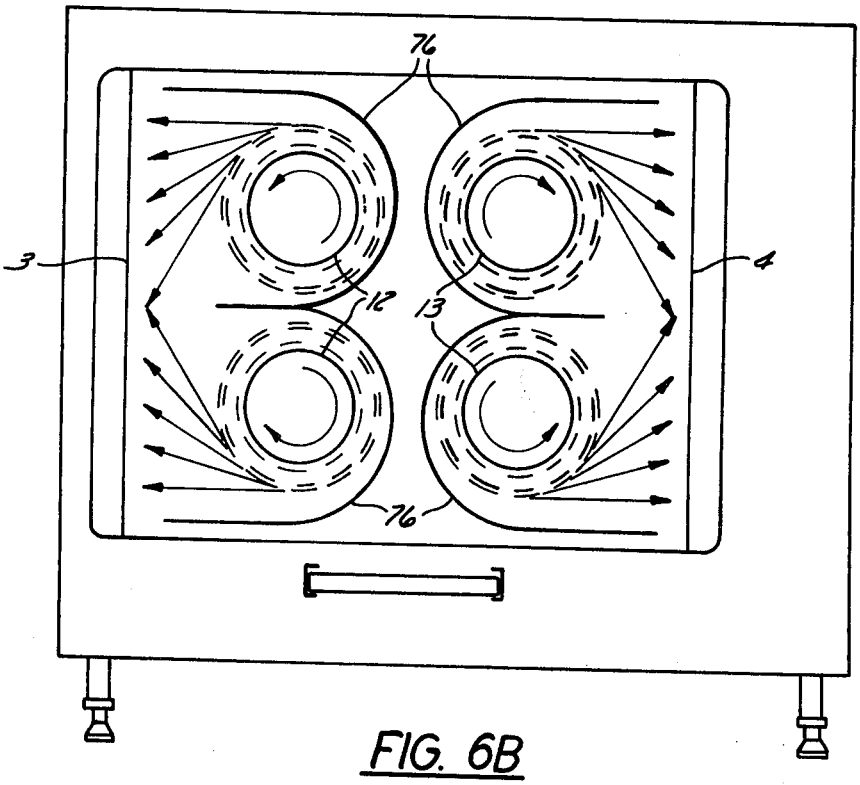
Figure 7:
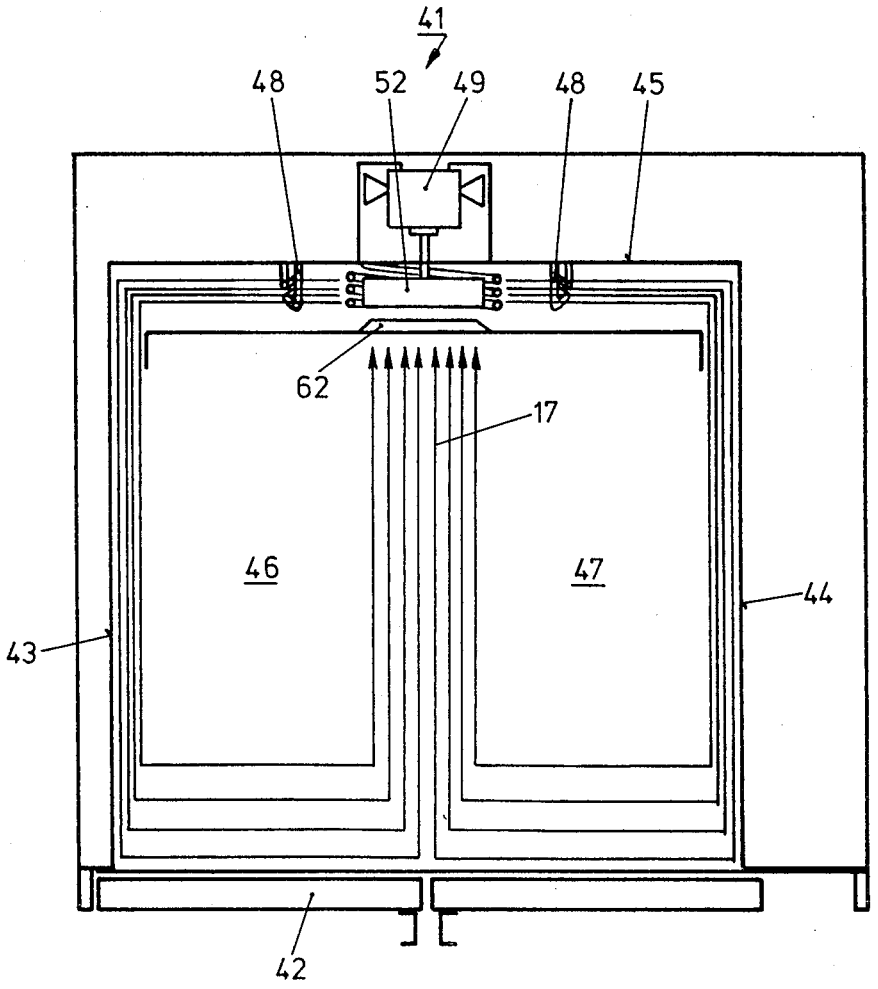

Each of FIGS. 6A and 6B is a section through the oven according to FIG. 5, taken on section line VI—VI of FIG. 5, FIG. 6A showing conditions when the blowers rotate in one direction and FIG. 6B showing conditions when the blowers rotate in the opposite direction, FIG. 7 is a horizontal section through a convection oven similar to FIG. 5 but using a single blower.

The baking oven 1 has a swingable front wall or door 2 as well as two side walls 3 and 4 and a rear wall 5. At the bottom it is closed by means of a bottom wall 6, and of course it also has a top wall. The walls establish a baking chamber 7 in the main portion of the oven which lies at its front. On the rear wall 5 there is a gas burner mixing chamber 8 with a gas delivery duct 11. The mixing chamber 8 opens forwardly into a nozzle block or burner 28, which provides a heat source at the rear of the oven that radiates forwardly and produces hot combustion gases. The nozzle block 28 is symmetrical to a vertical medial plane that is substantially midway between the side walls 3 and 4 of the oven.

Just in front of the rear wall 5 are an even number of blower rotors 12 and 13 that are located at opposite sides of the nozzle block 28 in an arrangement symmetrical to the vertical medial plane. In the present case there are four blower rotors 12, 13, one pair on each side of the medial vertical plane, and the two rotors of each pair are located one above the other in substantially symmetrical relation to a horizontal medial plane through the oven. The rotational axis of each rotor 12, 13 is substantially horizontal and normal to the rear wall 5. As herein shown, each blower rotor 12, 13 is driven by its own electric motor 9, 10, which is mounted on the rear wall behind the rotor and coaxial with it; but it will be obvious that two or more of the rotors could be driven by one motor. The motor or motors for the blowers are in any case periodically reversible under the control of switching means 82. Each blower rotor 12, 13 has radial vanes to be equally effective in both directions of its rotation.

Figure 1:
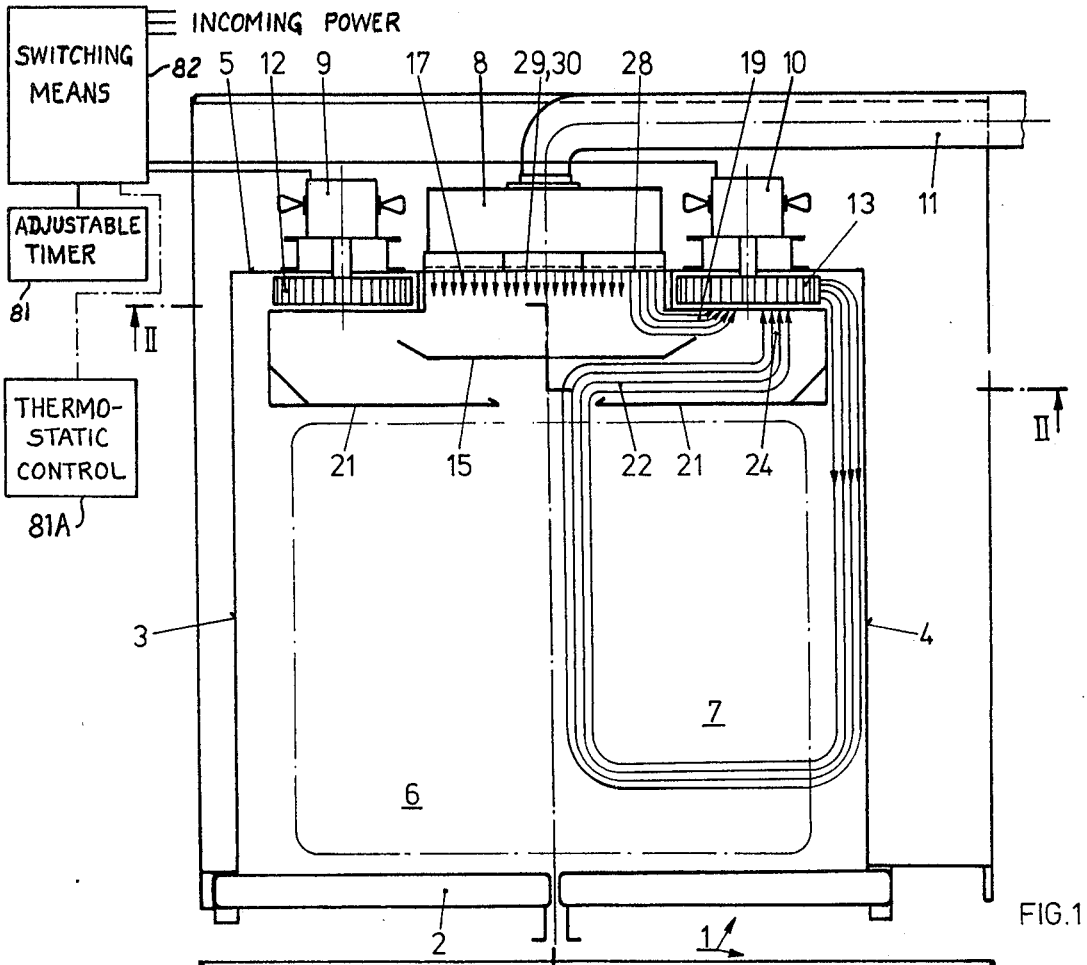
FIG. 1 is a horizontal section through a convection air oven of the gas heated type, taken on section line I—I of FIG. 2.

In front of the nozzle block 28 and the rotors 12, 13, extending partway across the rotors of each pair in forwardly spaced relation to the nozzle block and the rotors, is a rear deflecting or baffle wall 15 that receives and reradiates the radiant heat from the combusting gases at the nozzle block and deflects the hot combustion gases laterally towards the respective blower inlets along flow paths designated by arrows 17 in FIG. 1. At the blowers the hot combustion gases are mixed with cooler air which is returning from the oven and which is guided to the blower inlets by front deflecting or baffle walls 21 that are spaced in front of the rear baffle wall 15 and cooperate with it to define return air passages 22. The rear baffle wall 15 and the front baffle walls 21 cooperate to divide the baking chamber 7 in the front portion of the oven enclosure from a mixing chamber which is behind those baffle walls and which contains the heat source 28 and the blower rotors 12, 13.

Figure 2:
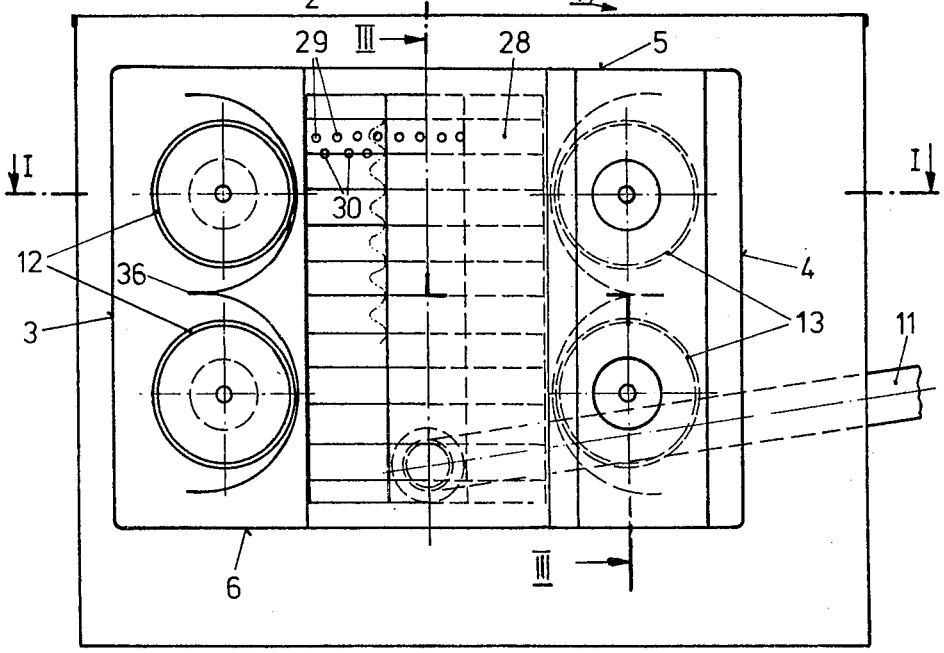
FIG. 2 is a vertical section through the oven of FIG. 1, taken on section line II—II of FIG. 1.
Figure 3:
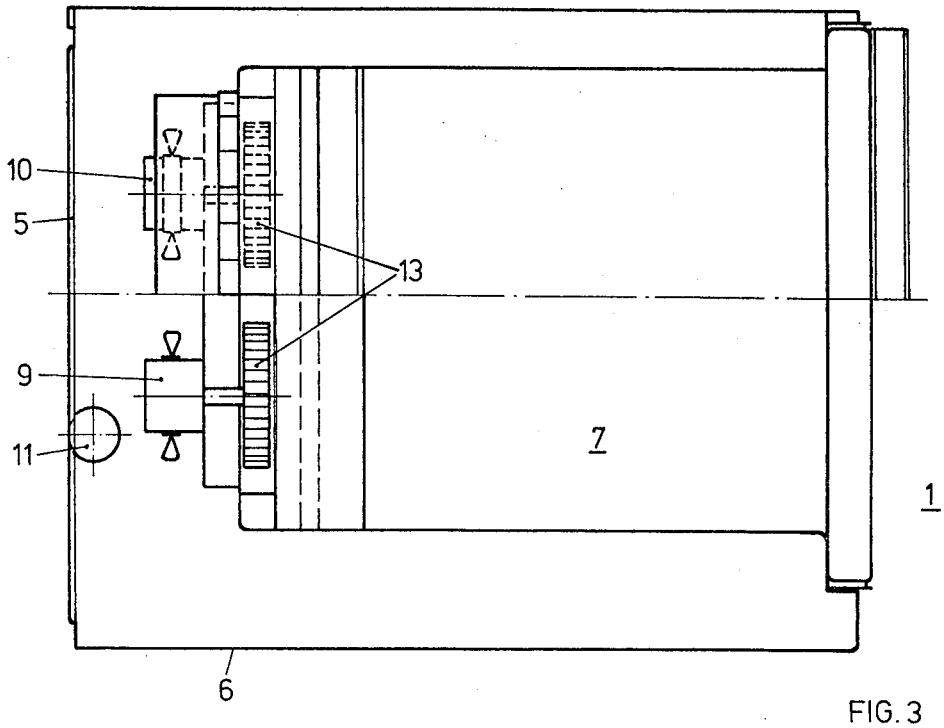
FIG. 3 is a section through the oven taken on section line III—III of FIG. 2.
Figure 4:
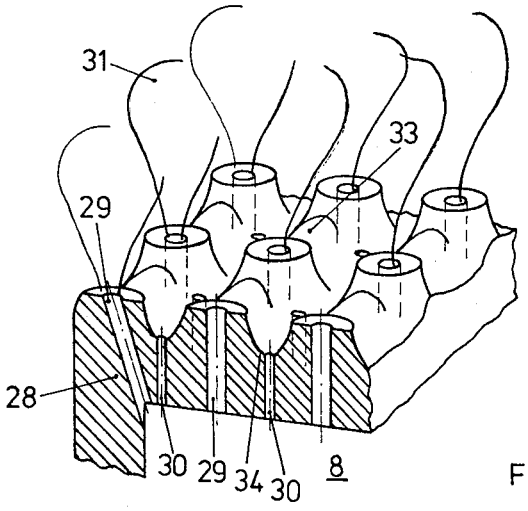
FIG. 4 is a perspective illustration of a section through the gas burner-mixing chamber with a ceramic nozzle block that is wavy in two directions, having main and pilot nozzles, together with the flame carpet, shown in stylized illustration.

As shown in FIGS. 1 and 2, a gas-heated oven that embodies the principles of the present invention has a surface-type radiant heat source for heating the air, comprising the nozzle block 28 which can be made of ceramic material and which is preferably wavy in one direction (FIG. 2) or in two mutually perpendicular directions (FIG. 4), so that there are wave crests 33 and wave troughs 34. Main nozzles 29 that are adjacent to one another are provided on the wave crests 33, while in the wave troughs 34 there are provided auxiliary nozzles 30 for the pilot flames. The nozzles 29 and 30 are communicated with the gas-air mixing chamber 8. They are so formed that with burning flames they define a short-flamed, cohesive flame carpet 31.

Each blower rotor is embraced by a substantially semicylindrical shell or housing 36 that has its end portions projecting away from the vertical medial plane. Each housing 36 thus cooperates with its rotor to provide an upper air outlet and a lower air outlet, from each of which air is discharged in a direction away from the vertical medial plane, and air propelled by the blower will issue from that one of the two outlets towards which the rotor is rotating around the shell.

The rear baffle wall 15 extends through substantially the full height of the oven, and its main portion, which extends entirely across the nozzle block 28, is substantially parallel to the rear wall 5 and spaced forwardly from it. As shown, the opposite side edge portions of the rear baffle wall 15, which are in front of the respective pairs of blowers, are angled rearwardly to some extent, to be effective in deflecting combustion gases towards the blower rotors. The front baffle walls 21, which extend substantially from top to bottom of the oven and are substantially parallel to the rear wall 5, are spaced a distance forwardly from the rear baffle wall 15 and are preferably coplanar with one another. The remote vertical edges of the front baffle walls 21 are spaced from the respective side walls 3 and 4 of the oven to cooperate with those side walls in defining substantially unrestricted inlets to the baking chamber through which air discharged from the blowers, mixed with combustion gases, can flow into the baking chamber. The two front baffle walls 21 have their adjacent vertical edges spaced to opposite sides of the vertical median plane to define between them a substantially unrestricted return air outlet from the baking chamber 7, through which air can flow rearwardly towards the blowers. Return air passing through this outlet is deflected laterally in opposite directions by the rear baffle wall 15, which cooperates with the front baffle walls 21 to define laterally oppositely extending return air passages 22 that lead to the blower inlets and which serves as a secondary heat source that effects some heating of the return air flowing along it. In a suction mixing chamber 24 for each blower pair, just in front of their inlets and conjointly defined by the rear baffle wall 15 and the front baffle walls 21, the return air is combined with hot combustion gases, to be thoroughly mixed in passage through the blower rotors. The horizontal circulation is thus generally as depicted by the flow line arrows in FIG. 1.

In addition, however, there is a substantial component of vertical circulation and general turbulence in the oven which maintains uniform conditions of temperature and humidity throughout the baking chamber and which is due to the directions of rotor rotation, in cooperation with the semicylindrical rotor housings or shells 36. At a particular time in the operating cycle, the upper rotor of the left-hand rotor pair 12 (see FIG. 6B) will be rotating counterclockwise, while the lower rotor of that pair will be rotating clockwise; and meanwhile the upper rotor of the right-hand pair 13 is rotating clockwise while the lower rotor of that pair is rotating counterclockwise. Under these conditions, air will be discharged towards the top and towards the bottom of the respective side walls 3 and 4, to superimpose substantial components of vertical flow upon the general flow pattern depicted in FIG. 1. During a subsequent period of the baking cycle, every rotor rotates in the opposite direction (FIG. 6A), and consequently the blowers discharge air towards the medial portion of the respective side walls 3 and 4, so that the components of vertical flow are substantially different from those produced during the preceding period. By thus reversing the rotors periodically, and thereby periodically and rather systematically changing the pattern of airflow through the baking chamber 7, remarkably constant conditions of temperature and humidity can be maintained throughout the baking chamber. Because the air inlets and the air outlet of the baking chamber are substantially unrestricted, there is no overpressure or underpressure in the baking chamber, so that air flows through it at a relatively high velocity and with substantial and widespread turbulence, and in this respect, too, maintenance of constant and uniform conditions is assured.

It will be apparent that, instead of the scheme of blower rotation described above, the upper and lower rotor of each blower pair could rotate in the same direction during each period. Thus, during clockwise rotation of the rotors of the left-hand blower pair 12, the blowers would discharge air towards the medial and bottom portions of the respective side walls 3, 4, and during counterclockwise rotation of the blowers 12 the blowers would discharge air towards the medial and top portions of the side walls. The first described scheme of rotor rotation will in most cases be preferred because of the top-to-bottom symmetry of the pattern of flow that it produces.

FIG. 5 illustrates an electrically heated oven embodying the principles of this invention, having an enclosure defined by side walls 43, 44, a rear wall 45, a swingable front wall or door 42, a bottom wall 46, and of course a top wall. The blower rotors 52, 53 are arranged in pairs just in front of the rear wall 45, substantially as described above, but in this case the respective rotor pairs can be closer to the vertical median plane (although again symmetrically spaced to opposite sides of it) because the heat source need not be mounted between them. Instead, the heat source comprises a plurality of electrical resistance heating rods 48, which are, at least in part, arranged to comprise a plurality of coils, each coaxially surrounding one of the rotors, and which are secured to the rear wall 45. A semi-cylindrical shell or housing 76 embraces each rotor and the heating coil that surrounds the rotor, the shells 76 being arranged as described above. Each rotor 52, 53 is driven by its own coaxial motor 49, 50, which is in this case mounted on the back side of the rear wall 45.

In this case a single baffle or deflecting wall 61, parallel to the rear wall 45 and spaced forwardly from the blowers, separates the baking chamber 47 from the mixing chamber that contains the blowers and the heat sources and defines the inlets and outlets of the baking chamber 47. The baffle wall 61 extends vertically through substantially the full height of the oven, but its end edges are spaced from the respective side walls 43, 44 to provide the substantially unrestricted air inlets to the baking chamber. The outlets from the baking chamber are defined by holes or ports 62 in the baffle wall 61, each coaxial with one of the rotors 52, 53 and of about the same diameter as the rotor behind it to provide for substantially unrestricted return air flow to that rotor. The rotors again have radial vanes, to be equally effective in both directions of rotation. The general horizontal flow pattern is depicted by arrows 57 in FIG. 5, but again there is superimposed upon this horizontal flow pattern a vertical flow component which changes direction from time to time with reversal of the blower rotors as described above and as illustrated in FIGS. 6A and 6B.

As schematically illustrated in FIG. 1, the periodic reversal of the blower motors 9, 10 or 49, 50 is accomplished automatically by means of an adjustable timer 81, which can be a generally known mechanism comprising a timing motor and a relay that is energized intermittently at regular intervals during operation of the timing motor. The relay controls switching means 82, which can likewise be a generally known mechanism and can comprise a set of two-condition reversing switches, one for each blower motor, each connected in the energizing circuit for its motor. Typically, reversal of the blowers can take place every two minutes.

It is possible to provide only two, or six, or any other even number of blowers, which are arranged symmetrically to the medial plane of the oven.

By means of this symmetrical arrangement, in cooperation with the semicylindrical blower shells and the substantially unrestricted inlets and outlets of the baking chamber, it is possible to dispense with the slitted guide sheets that have heretofore been built into baking chambers for conducting the heating air, and their ommission simplifies keeping the interior of the baking oven clean.

By means of suitable regulating instrumentalities, the circulated air mixture of the blowers can be matched to the baked goods. The time relay 81 that serves for reversing the rotational direction of the motors can be adjustable manually; or instead, a thermostatically controlled microprocesser 81A can take over its functions, reversing the blower means in response to the attainment of predetermined temperature conditions in the oven. Thereby a nearly uniform air temperature is produced which has the advantage of bringing about optimum baking results.

The employment of a plurality of smaller blowers substantially reduces noise development and affords a good space utilization, with minimum external dimensions and maximum usable space.

What is claimed as the invention is:

1. An oven for foods comprising an enclosure having front, rear and side walls, heating means, and blower means whereby air is recirculated past said heating means, said oven being characterized by:

A. said heating means being arranged in said enclosure
  (1) adjacent to said rear wall and
  (2) substantially symmetrically to a plane midway between said side walls and parallel to them;

B. said blower means comprising
  (1) an even number of rotors, all located forwardly adjacent to said rear wall and having rotational axes normal to said rear wall, said rotors being arranged
    (a) symmetrically to said plane and
    (b) adjacent to said heating means to produce a flow of air thereacross;
  (2) motor means for driving each rotor alternately first in one direction of rotation and then in the other, and
  (3) housing means for each rotor, each said housing means cooperating with its rotor to cause air propelled thereby to be discharged in a direction away from said plane and to cause such air to be discharged at a higher level when the rotor rotates in said one direction and at a lower level when it rotates in said other direction;

C. substantially vertical baffle wall means in said enclosure,
  (1) extending transversely to said plane in front of said heating means and said blower means to divide the interior of the encosure into a rear mixing chamber and a front baking chamber,
  (2) said baffle wall means being spaced from said side walls to cooperate with each of them in defining an air inlet that opens substantially unrestrictedly into the baking chamber from the mixing chamber, and
  (3) said baffle wall means defining air outlet means opening substantially unrestrictedly from the baking chamber and through which air therefrom can recirculate back to said rotors and said heating means, said air outlet means being
    (a) in laterally inwardly spaced relation to said air inlets and
    (b) in symmetrical relation to said plane.

2. The oven of claim 1 wherein said heating means comprises a radiant heat source, further characterized by:
  (1) said heating means being arranged to radiate frowardly towards said baffle wall means; and
  (2) said baffle wall means being of a material which conducts heat so as to radiate and conduct heat into said baking chamber.

3. The oven of claim 1, further characterized by: said housing means for each rotor comprising a semicylindrical shell which embraces the rotor and which has free end portions that project away from said plane.

* * * * *